United States Patent [19]

Zecman

[11] Patent Number: 4,667,729

[45] Date of Patent: May 26, 1987

[54] SHOT TIP FOR COLD CHAMBER DIE CASTING MACHINE

[76] Inventor: Kenneth P. Zecman, 46520 Strathmore, Plymouth, Mich. 48170

[21] Appl. No.: 834,590

[22] Filed: Feb. 28, 1986

[51] Int. Cl.[4] ..... B22D 17/10; B22D 17/20

[52] U.S. Cl. ..... 164/312; 164/314; 425/547

[58] Field of Search ..... 164/312, 314; 425/547

[56] References Cited

U.S. PATENT DOCUMENTS

| | | | |
|---|---|---|---|
| 3,605,871 | 9/1971 | Whitehead, Sr. et al. | 425/547 X |
| 4,154,288 | 5/1979 | Borgen | 164/312 X |
| 4,275,864 | 6/1981 | Richards | 427/547 X |
| 4,311,185 | 1/1982 | Zimmerman | 164/312 X |
| 4,598,762 | 7/1986 | Glas | 164/312 |

FOREIGN PATENT DOCUMENTS

| | | | |
|---|---|---|---|
| 2233132 | 1/1974 | Fed. Rep. of Germany | 164/312 |
| 2904883 | 7/1979 | Fed. Rep. of Germany | 164/312 |

*Primary Examiner*—Kuang Y. Lin
*Assistant Examiner*—J. Reed Batten, Jr.
*Attorney, Agent, or Firm*—Krass & Young

[57] ABSTRACT

An improved shot tip for a metal injecting shot sleeve wherein the tip comprises a beryllium-copper alloy head having a domed front face and an interior cooling chamber. A baffle is located on the end of a coolant exhaust tube inside of the coolant chamber. Coolant water enters the shot tip head by flowing around the outside of the tube and exits the shot tip head through the tube itself, the aluminum baffle and a flow directing deflector.

5 Claims, 4 Drawing Figures

SHOT TIP FOR COLD CHAMBER DIE CASTING MACHINE

INTRODUCTION

This invention relates to apparatus for injecting molten metals into a mold cavity, said apparatus being commonly referred to as a "cold chamber", and more particularly to an improved "shot tip" which serves as the plunger or ram in the injection apparatus.

BACKGROUND OF THE INVENTION

It is well known that molten metals such as aluminum, zinc, magnesium and other metals and alloys of same can be injected into a mold cavity by means of a device known as a cold chamber. This well known device comprises a cylindrical sleeve having a through bore which is adapted to receive a plunger or "shot tip". The sleeve is provided with a radial opening called a "well" through which the molten metal is introduced to the interior bore of the sleeve or chamber. After the metal has been introduced and accumulated in sufficient quantity, power means are activated to drive the shot tip forward, injecting plunger-fashion the molten material into the mold cavity.

Cold chambers or shot sleeves and particularly shot tips operate in an extremely hostile environment as far as thermal strain and wear is concerned. Accordingly the devices typically exhibit a short life span.

One of the principal problems giving rise to the short life of the prior art shot tip is the extreme heat experienced by the face of the shot tip; i.e., that portion of the shot tip which comes into contact with the injected molten metal. Cooling is attempted by hollowing out the shot tip and creating a coolant water conduit axially into and out of the hollow area. However, it is believed that the prior art arrangement which involves pumping water through a central tube and exhausting around the outside of the tube is inefficient because the coolant water experiences a dramatic temperature rise and vaporization as it emerges from the tube and impacts the extremely hot front wall or face of the shot tip. When vaporization occurs, the pressure within the cooling chamber increases to the point where it is greater than the line pressure of the water and, at least for an instant, the flow of coolant is interrupted or slowed. Moreover, inefficient flow within the hollow chamber results in much of the water passing thru without carrying heat away. High heat causes thermal expansion, and inordinate wear on the leading edge of the piston.

Improvements in shot tip designs which can alleviate or eliminate these and other problems are needed so that injection operations may be carried out more efficiently and less expensively.

SUMMARY OF THE INVENTION

According to a first aspect of the invention a shot tip for use in a cold chamber or shot sleeve comprises a head which has formed therein an internal chamber to receive coolant through a passage defined by the radial space between the outer surface of an outlet tube and the inner diameter of a bore in the shot tip head. Means are provided to cause the coolant to follow a smooth flow path around the chamber and into the tube end in such a fashion as to drastically improve the rate at which heat is carried away from the face or leading edge of the piston.

According to a second aspect of the invention, the shot tip is formed with an undercut or shoulder defining a narrow, forward-facing annular step surface a substantial distance longitudinally back from the nose of the shot tip such that the majority of the molten metal contacts the nose surface. This, in effect, makes the large-area and large-volume nose portion a heat sink which permits the cylinder-contacting peripheral surface adjacent the shoulder cooler and less susceptible to wear-producing thermal expansion.

In the preferred form the shot tip of the present invention exhibits a number of major changes from the industry standard.

First, the coolant or water is pumped into the piston in reverse fashion. Instead of pumping water into the piston via a copper tube, I alter the flow and exit the water via the copper tube. This means that the water then enters the piston via a hole in the plunger rod or actuating rod. Since the copper tube is concentric with this hole in the rod, the water enters the piston through the area between the wall of the inside diameter and the copper tubing.

Next, the copper tube protrudes into the piston from the plunger rod. Because the water path is reversed as explained above, I can attach a baffle on the end of the tubing to control not only the flow path of the water but also its velocity through the piston by varying the size of the baffle. By increasing the size of the baffle the area through which the water passes is decreased, thereby increasing the water's velocity. It has already been determined that to achieve optimum cooling from the circulating water it should travel at a rate close to 10 ft/sec. It must also contact as much surface area as possible of the object intended to cool. To help direct the water out of the piston I provide a deflector to mount on the end of the baffle. The deflector directs the hot water or steam back through the I.D. of the baffle and into the copper tube which is attached to the baffle.

Further, the flow path of the water is such that it will reach the hottest part of the piston directly in front of the exhaust hole leading into the copper tubing. If the water is heated to its flash point, the steam that is formed will not interfere with the incoming water supply.

In fact, when steam is passed in the copper exhaust tube, the incoming water which surrounds the copper tube will condense the steam and form a vacuum. This vacuum creates a siphon effect which pulls the water along to replace the vacuum. This system insures that any increase in volume produced by the creation of steam will not form a back pressure and prohibit or slow the flow of water through the piston.

Further, even though I have increased the rate at which the piston is cooled; it is still impossible to eliminate high heat (1250° F.) across the entire face of the piston. Therefore, I have incorporated an undercut bringing the leading edge of the cylinder-contacting portion of the piston back along the diameter. I have undercut my shot tip 0.625 "and as much as 1.000." My objective was to bring the water cavity forward in the piston, increasing the surface area of the tip nose which contacts the molten metal, causing this nose to act as a heat sink and reduce radial expansion in the part of the tip which slides against the cylinder wall.

The advantage of this design is that I can better control the expansion across the diameter at the point of the leading edge which must seal against the sleeve. The excessive wear caused by the expansion of the piston against the shot sleeve wall is the primary cause of tip failure.

DETAILED DESCRIPTION OF THE ILLUSTRATIVE EMBODIMENTS

Figure 1:
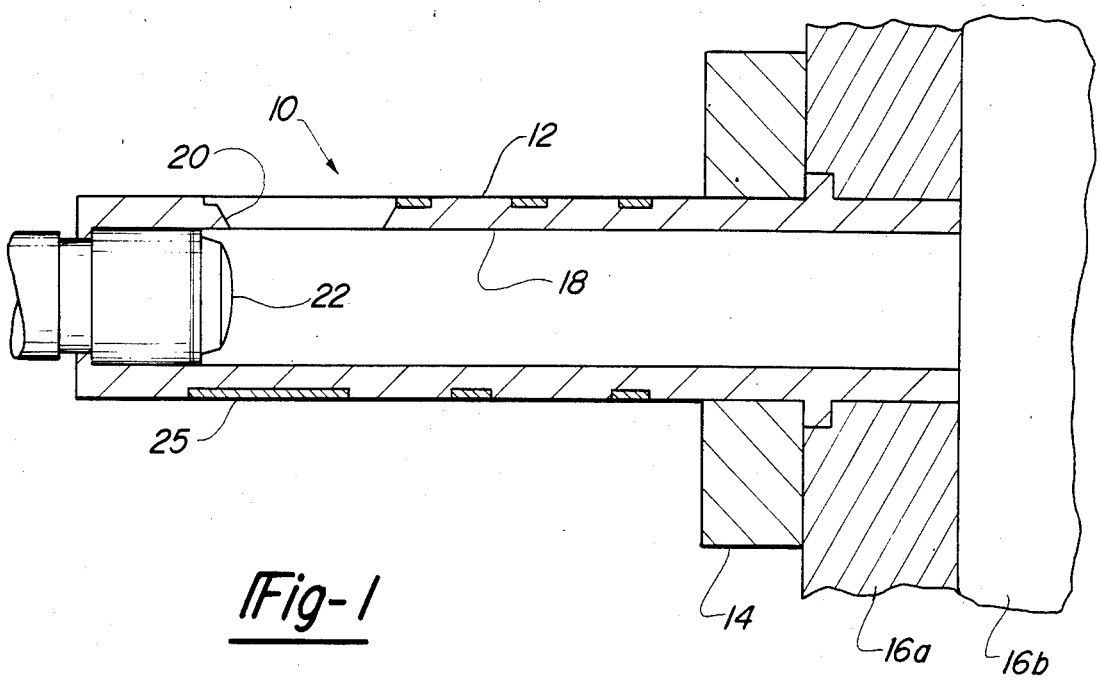
FIG. 1 is a side view in cross section of a shot sleeve embodying the invention.

Referring to the drawing the invention is embodied in an injector 10 for molten metal comprising a cylindrical shot sleeve 12 mounted in a platen 14 and projecting into the ejector portion 16*a* of a casting die 16*a*, 16*b*. Sleeve 12 is provided with a hollow interior bore 18 which is loaded with molten metal by way of a radial opening 20 to form what is known in the art as a well. A ram, commonly called a shot tip 22 is tightly mounted within the bore 18 and functions to drive the molten metal into the cavity or mold on command. Suitable power means such as an hydraulic cylinder are connected to the shot tip 22 as will be apparent to those skilled in the injection molding arts. As is more fully disclosed in my copending application Ser. No. 678,245 filed Dec. 5, 1984 and now U.S. Pat. No. 4,623,015 issued Nov. 18, 1986, the sleeve 12 may include a spiral pattern 25 of copper welded or otherwise fused into a shallow spiral groove extending from the well area toward the clamped end of sleeve 12 to distribute heat from the well area along the length of sleeve 12 to help prevent molten metal in the sleeve 12 from forming a tin can or frozen shell along the sleeve wall.

Figure 2:
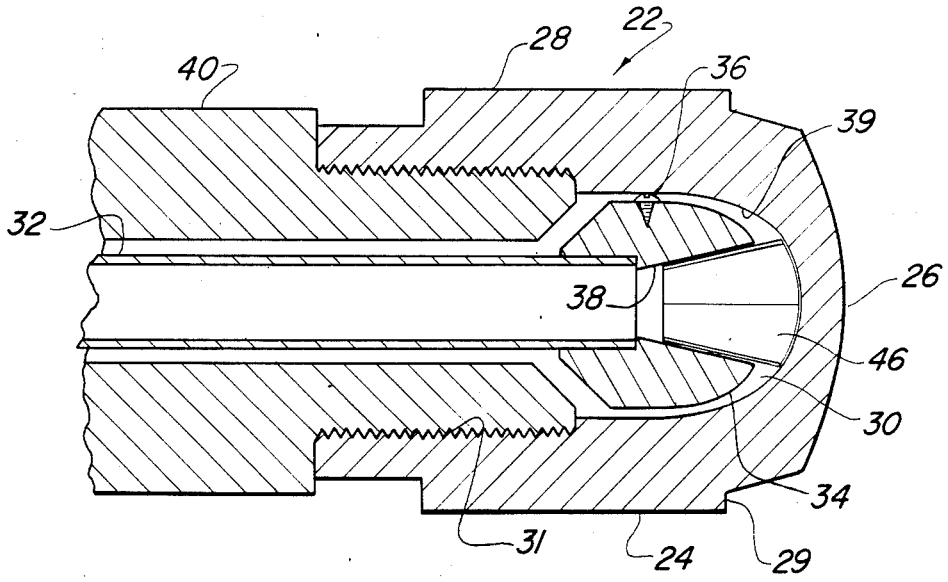
FIG. 2 is a side view in cross section of a shot tip embodying the invention.
Figure 3:
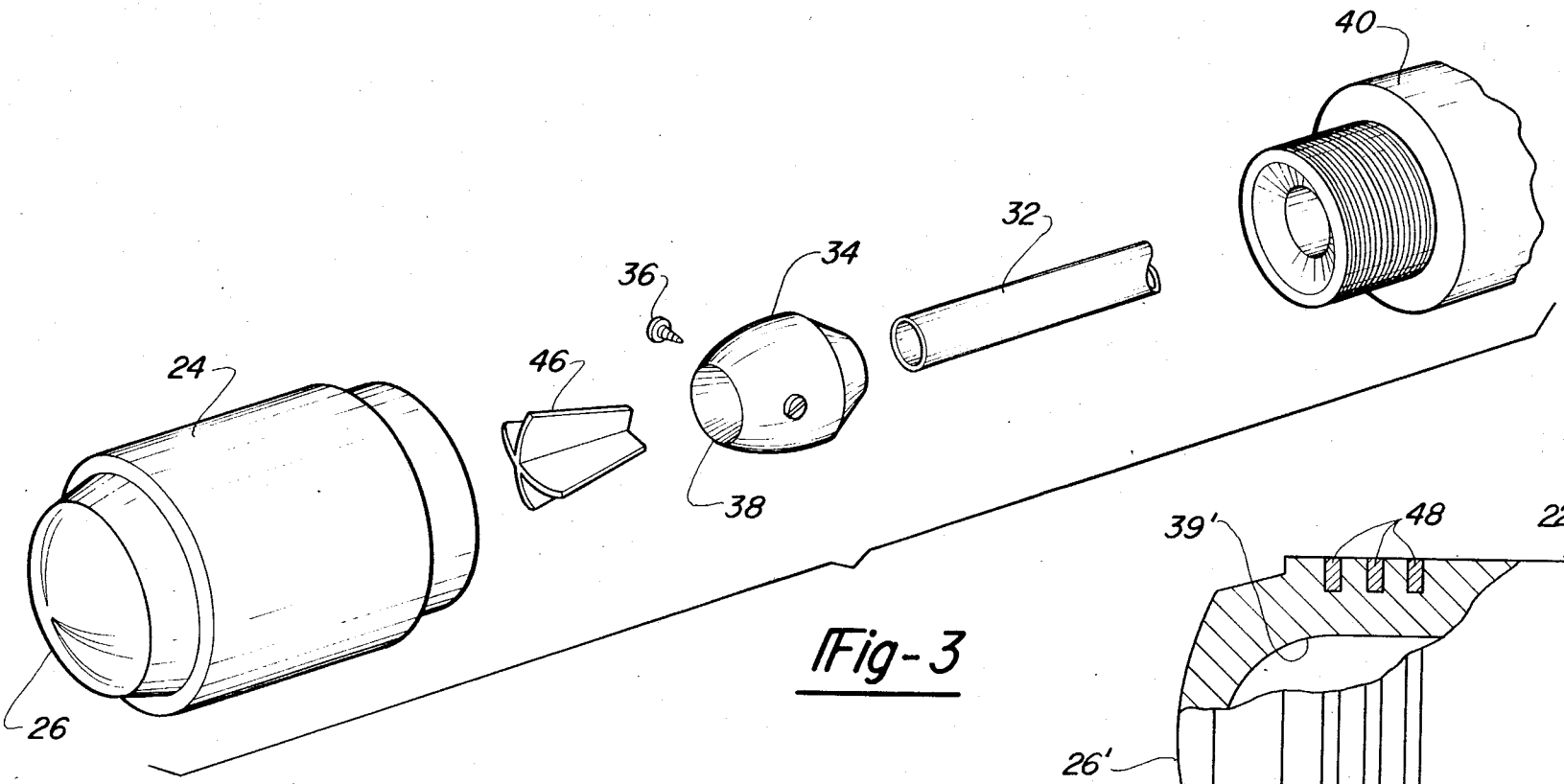
FIG. 3 is a exploded perspective view of the shot tip illustrated in FIG. 2.

Referring now specifically to FIGS. 2 and 3, the shot tip 22 comprises a beryllium-copper alloy head 24 having a substantially cylindrical peripheral surface which mates with the interior bore 18 of shot sleeve 12 as depicted in FIG. 1. The head 24 is characterized physically by a domed front wall 26 which protrudes axially from the cylindrical peripheral wall 28. The domed wall recedes to a shoulder or step surface 29 which lies, in the case of a 4¼" diameter tip, about 1" longitudinally rearward of the wall 26. The forward facing area of step surface 29 is on the order of 6% of the total frontal area of the tip 22 contacting molten material. Accordingly, most heat from the material is absorbed into the protruding nose or dome of tip 22 ahead of surface 29, reducing thermal expansion of the tip adjacent surface 29 and reducing wear as the tip 22 slides within the sleeve 12.

The head 24 is hollowed out to provide an internal coolant chamber 30 the left hand portion of which is provided with internal threads 31 to engage with the external mating threads of a plunger body 40. A tube 32 extends axially into the chamber within the head 24 to form a first coolant flow path between the external surface of the tube 32 and the interior surfaces of the head 24 and the plunger body 40. Tube 32 defines a second coolant flow path within the tube 32 itself. The first flow path is inbound and the second flow path is outbound and these flow directions are important to the operation of the device as hereinafter described.

Because of the higher strength of the domed wall 26 relative to a flat wall or the like, the wall thickness in the area of the domed face may be reduced relative to prior art devices thereby to enhance thermal exchange between the coolant water and molten metal through the physical structure of the head 24 and to reduce thermal expansion of the head with resulting wear.

A baffle 34 of aluminum is disposed within the internal chamber 30 of the head 24 and is configured to conform generally to the walls of the chamber 30 but is slightly smaller so as to be held in spaced relationship with the chamber walls by means of three spacer screws 36 arranged at 120° intervals. The baffle 34 is mounted on the exterior end of the tube 32 and has a flaring through-bore 38 in fluid communication with the tube 32. As coolant flow tends to center the baffle 34, screws 36 may be eliminated in most cases.

In essence the baffle 34 causes the inbound coolant to flow along and in contact with the walls of chamber 30 for maximum cooling efficiency. Spacing between baffle 34 and internal wall 39 is selected to slow the coolant flow rate down to about 10 ft/sec for optimum cooling. A deflector 46 has orthogonal vanes configured to conform generally to the through-bore 38 and is mounted within through-bore 38. The right hand end of the deflector 46, as shown in FIG. 2, extends into contact with the surface of chamber 30 and serves to direct the coolant flow into the mouth of baffle 34 and thence into the tube 32 by which it is exhausted.

In operation, the shot tip 22 of the subject invention is assembled as previously described and placed into the shot sleeve 12 such as diagrammatically illustrated in FIG. 1. The coolant water is directed inwardly along a path which lies between the tube 32 and the interior surfaces of the elements 24, 40. The baffle 34 directs the cooling water radially outwardly so as to flow directly along the internal wall 39 toward the deflector 46 where a flow reversal occurs. Thereafter the coolant water enters the bore 38 of the baffle 34 and flows outwardly through conduit tube 32. The water is caused, by this arrangement, to suffer far less thermal shock and less vaporization than the arrangement of the prior art device wherein the water flows inwardly through the tube and impacts directly against the front wall of the shot tip. Also, since the deflector 46 is located at the hottest portion of the internal wall 39, i.e. the portion where the most steam is generated during operation of the shot tip, any steam is instantly directly out of the coolant chamber 30 and into tube 32, preventing pressure build-up in the coolant chamber 30. Furthermore, the tube 32 is surrounded and cooled by the flow of cooling water in the coolant and cooled by the flow of cooling water in the coolant chamber 30. Steam directed into the tube 32 by deflector 46 condenses and loses volume, creating a vacuum or siphon which further assists in preventing pressure build-up in the coolant chamber 30. The relatively thin wall structure of the domed face 26 promotes thermal transfer from the molten metal to the cooling water and reduces thermal expansion of the head 24 at the forward portions.

Figure 4:
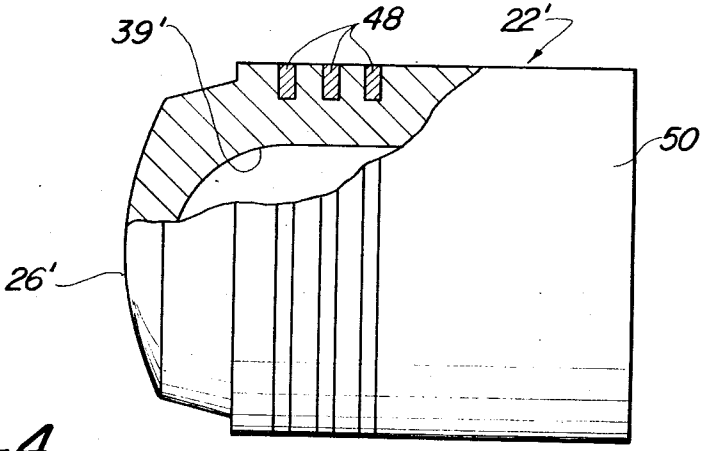
FIG. 4 is a side view of an alternative shot tip design.

FIG. 4 illustrates an alternative embodiment wherein the shot tip 22' is fabricated according to the design shown in FIG. 2 but from steel instead of beryllium-copper alloy. This provides an economic advantage since steel is currently (and typically) much less expensive than both beryllium-copper and solid copper. Moreover, steel can be heat treated or surface hardened to increase wear resistance at the peripheral surface which contacts the cylinder wall of sleeve 12.

However, steel has a lower thermal conductivity and, by itself, cannot transfer heat away from surface 26' to the internal wall 39'. For this reason rings 48 of copper are welded or fused into grooves formed in the peripheral surface 50 of tip 22'. These rings 48 increase heat transfer in the area of the tip 22' where thermal expansion should be kept to a minimum.

It is to be appreciated that the device illustrated may be altered in various ways and take on varying physical configurations as best suits the particular application thereof.

I claim:

1. A shottip for use in a cold chamber die casting machine, the shot tip comprising:

a head having an internal chamber to receive a coolant;

a coolant exhaust tube extending into said chamber but spaced from the walls of said chamber and having an inlet end within the chamber; and flow directing means disposed within said chamber and operatively associated with said tube for directing inbound coolant over the outside surface of the tube, along the walls of said chamber and into the inlet end of said tube.

2. The shot tip as defined in claim 1 wherein said head is made of beryllium-copper alloy.

3. The shot tip as defined in claim 1 wherein said head exhibits a step surface and is made of steel with copper rings fused into the diameter immediately adjacent the step surface.

4. The shot tip as defined in claim 1 wherein said flow directing means disposed within said chamber comprises a baffle member mounted on the inlet end of the tube and having a through bore in fluid communication with the interior of said tube, said baffle member being externally of greater diameter than the tube for directing coolant flowing into the chamber outwardly against the interior surfaces of the chamber.

5. The shot tip as defined in claim 4 wherein said flow-directing means further comprises a deflector mounted in the bore of said baffle member, to direct coolant into the bore of said baffle member.

* * * * *